US010704111B2

(12) United States Patent
Berg et al.

(10) Patent No.: US 10,704,111 B2
(45) Date of Patent: Jul. 7, 2020

(54) SOLID LUBRICANT-COATED STEEL ARTICLES, METHOD AND APPARATUS FOR MANUFACTURING THEREOF AND QUENCHING OIL USED IN THE MANUFACTURING

(71) Applicants: APPLIED NANO SURFACES SWEDEN AB, Uppsala (SE); BODYCOTE VÄRMEBEHANDLING AB, Angered (SE)

(72) Inventors: Mikael Berg, Uppsala (SE); Mikael Fällström, Täby (SE); Boris Zhmud, Skogås (SE)

(73) Assignees: APPLIED NANO SURFACES SWEDEN AB, Uppsala (SE); BODYCOTE VÄRMEBEHANDLING AB, Angered (SE)

( * ) Notice: Subject to any disclaimer, the term of this patent is extended or adjusted under 35 U.S.C. 154(b) by 263 days.

(21) Appl. No.: 15/772,655

(22) PCT Filed: Oct. 25, 2016

(86) PCT No.: PCT/SE2016/051034
§ 371 (c)(1),
(2) Date: May 1, 2018

(87) PCT Pub. No.: WO2017/078592
PCT Pub. Date: May 11, 2017

(65) Prior Publication Data

US 2019/0153556 A1 May 23, 2019

(30) Foreign Application Priority Data

Nov. 2, 2015 (SE) ..... 1551414

(51) Int. Cl.

| | |
|---|---|
| ***C21D 1/58*** | (2006.01) |
| ***C23C 8/26*** | (2006.01) |
| ***C23C 8/50*** | (2006.01) |
| ***C23C 8/80*** | (2006.01) |
| ***C21D 1/06*** | (2006.01) |
| *C10M 169/04* | (2006.01) |

(52) U.S. Cl.
CPC ..... *C21D 1/58* (2013.01); *C21D 1/06* (2013.01); *C23C 8/26* (2013.01); *C23C 8/50* (2013.01); *C23C 8/80* (2013.01); *C10M 169/04* (2013.01); *C10M 2203/1065* (2013.01); *C10M 2227/065* (2013.01); *C10M 2227/066* (2013.01); *C10M 2227/09* (2013.01); *C10N 2240/40* (2013.01)

(58) Field of Classification Search
CPC .... C21D 1/58; C21D 1/06; C23C 8/26; C23C 8/50; C23C 8/80
See application file for complete search history.

(56) References Cited

U.S. PATENT DOCUMENTS

| | | | | |
|---|---|---|---|---|
| 3,729,417 | A | 4/1973 | Hashimoto et al. | |
| 3,855,014 | A | 12/1974 | De Vries et al. | |
| 4,049,473 | A * | 9/1977 | Davis, II | C21D 1/74 148/216 |
| 4,465,523 | A | 8/1984 | Katabuchi | |
| 4,477,293 | A | 10/1984 | Timmis | |
| 4,776,901 | A | 10/1988 | Heminghous | |
| 6,239,082 | B1 | 5/2001 | Hewson et al. | |
| 7,358,217 | B2 | 4/2008 | Sweet et al. | |
| 2003/0024380 | A1 | 2/2003 | Shimo et al. | |

FOREIGN PATENT DOCUMENTS

| | | | |
|---|---|---|---|
| EP | 0077627 | A2 | 4/1983 |
| EP | 0 534 010 | A1 | 3/1993 |
| EP | 1 505 175 | A1 | 2/2005 |
| EP | 2053144 | A1 | 4/2009 |
| GB | 782263 | A | 9/1957 |
| GB | 912018 | A | 12/1962 |
| JP | 61-186468 | A | 8/1986 |
| JP | 63-259247 | A | 10/1988 |
| JP | 11-092822 | A | 4/1999 |
| JP | 11-269630 | A | 10/1999 |
| JP | 1413631 | A2 | 4/2004 |
| JP | 2009-236034 | A | 10/2009 |
| JP | 2010-007128 | A | 1/2010 |

(Continued)

OTHER PUBLICATIONS

Mackenzie. "The Chemistry of Oil Quenchants," Heat Treating Progress, Oct. 2009, pp. 28-32 (6 pages total).

(Continued)

*Primary Examiner* — Jesse R Roe

(74) *Attorney, Agent, or Firm* — Birch, Stewart, Kolasch & Birch, LLP

(57) ABSTRACT

A method for manufacturing of steel articles comprises nitriding (210) a steel article at a nitrification temperature in the interval 350-650° C., giving a nitrided steel article. The nitrided steel article is quenched (220) in a reactive quenching oil from the nitrification temperature. The reactive quenching oil comprises at least one of S, P, B, Mo and W. Thereby, the quenching additionally comprises coating (222) of the nitrided steel article by a solid lubricant comprising at least one of S, P, B, Mo and W. An apparatus for manufacturing of steel articles, a quenching oil and a steel article produced by the method are also disclosed.

6 Claims, 5 Drawing Sheets

(56) References Cited

FOREIGN PATENT DOCUMENTS

| | | | |
|---|---|---|---|
| JP | 2015-151621 | A | 8/2015 |
| JP | 2012-137137 | A | 7/2017 |
| RU | 2112811 | C1 | 6/1998 |
| UA | 44492 | U | 10/2009 |
| WO | WO 03/091478 | A1 | 11/2003 |
| WO | WO 2015/125767 | A1 | 8/2015 |

OTHER PUBLICATIONS

Vanderbilt Chemicals, LLC, "Lubricant Additives," Jan. 31, 2013, pp. 1-21 (36 pages total), XP55080763.
Wang et al., "Tribological Properties of Plasma Nitriding GCr15 Steel under Lubrication with Borate Containing Nitrogen Additive," Journal of Mechanical Engineering, vol. 48, No. 19, Oct. 2012, pp. 128-133, with English abstract.

* cited by examiner

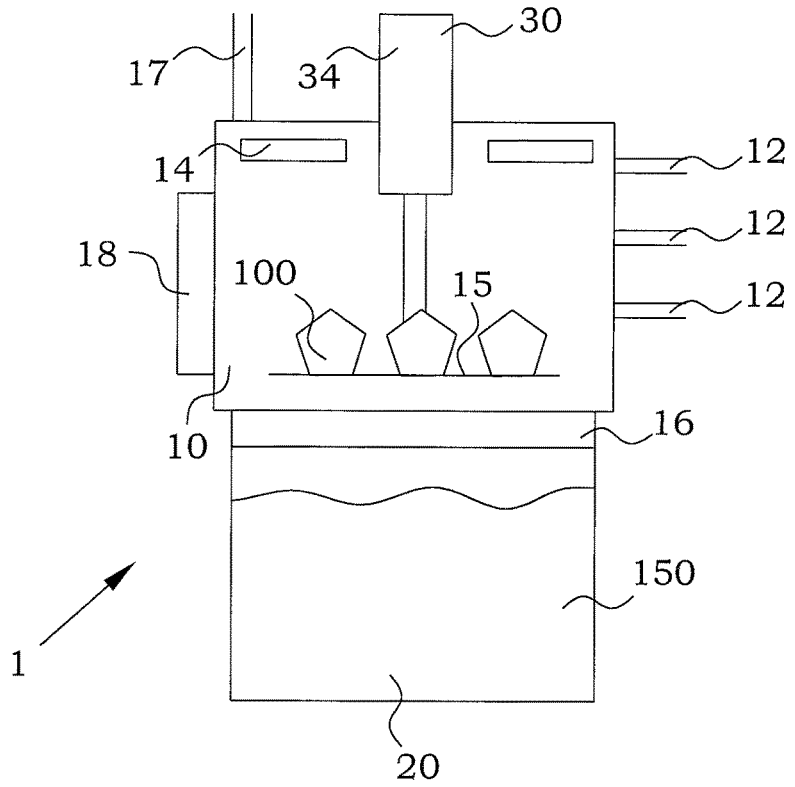
Fig. 7B
Fig. 8
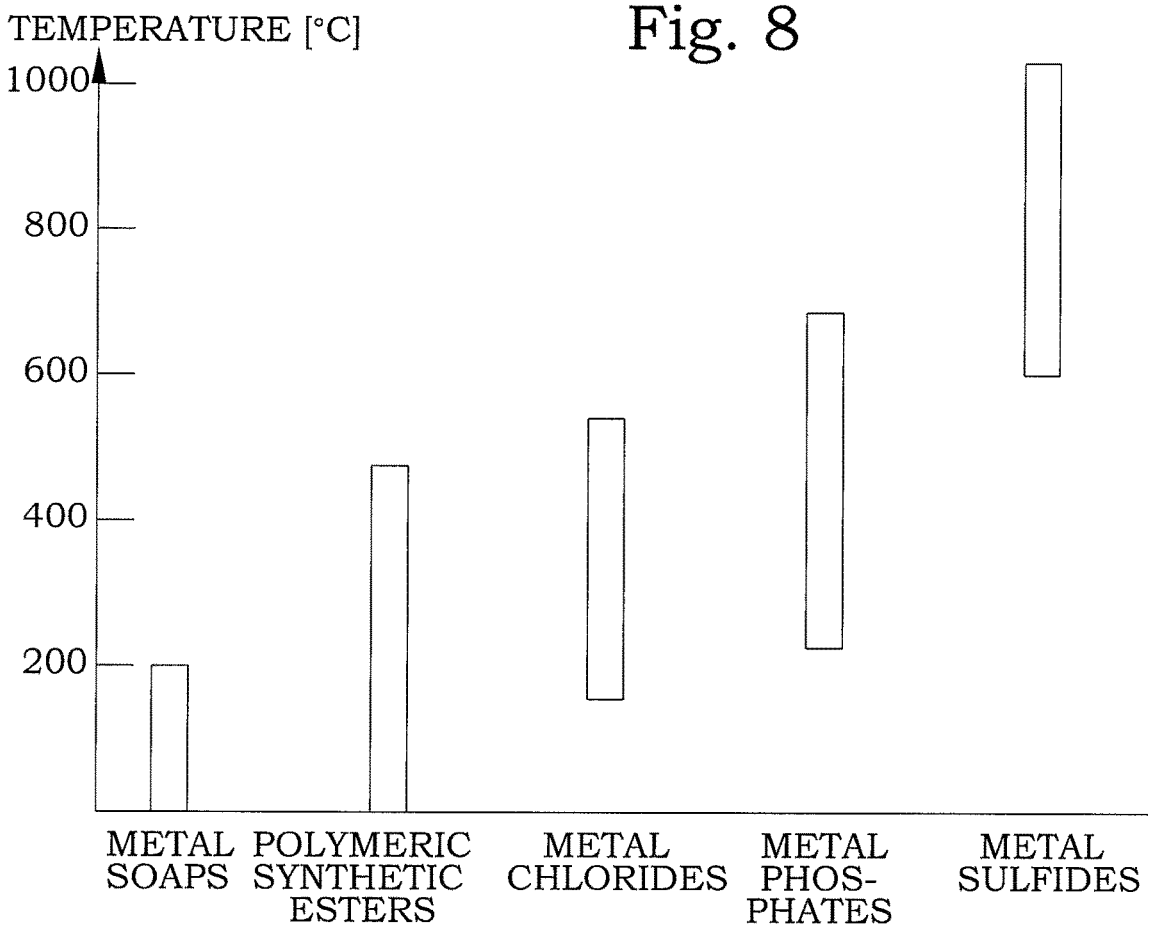

SOLID LUBRICANT-COATED STEEL ARTICLES, METHOD AND APPARATUS FOR MANUFACTURING THEREOF AND QUENCHING OIL USED IN THE MANUFACTURING

TECHNICAL FIELD

The present invention relates in general to lubricant-coated steel articles, methods, apparatuses and quenching oils for manufacturing thereof, and in particular to nitrided lubricant-coated steel articles.

BACKGROUND

Nitriding is a heat treating process that diffuses nitrogen into the surface of a metal to create a case hardened surface. Nitriding is most commonly used on low-carbon, low-alloy steels, however, during recent years, also higher alloyed steels have been nitrided with advantageous results.

The main nitriding methods used today are: gas nitriding, salt bath nitriding, and plasma nitriding, which are named after the medium used to donate nitrogen.

Nitriding typically imparts a high surface hardness which promotes high resistance to wear, scuffing, galling and seizure. Fatigue strength is increased mainly by the development of surface compressive stresses.

Nitriding is often performed at elevated temperature and is therefore typically ended by a cooling or quenching step in which the steel product is cooled down. Fast quenching after nitriding will increase the solution hardening effect from the entrapped nitrogen but this effect is proportionally small compared to the precipitation hardening effect derived from the formation of hard nitrides between alloying elements and nitrogen in the steel surface. Alloying elements such as Cr, Al, V, Ti and Mo forms hard nitrides in steel during nitriding and the level of such alloying elements in the steel has a huge impact on the nitriding result in terms of hardness, wear resistance and fatigue strength. Quenching oils and heat treatment fluids are designed for rapid or at least controlled cooling of steel or other metals as part of a hardening, tempering or other heat-treating process, such as nitriding.

Typical applications include gears, crankshafts, camshafts, racks, pinions, axles, races, drive shafts, center pins, cylinder blocks for hydraulic motors, vanes for pumps, piston skirts, chain components, slideways, cam followers, valve parts, extruder screws, die-casting tools, forging dies, extrusion dies, firearm components, injectors, plastic-mold tools, conveyor guides, etc.

Due to the typical beneficial properties of nitrided materials, they are often used in applications where the surfaces are exposed to mechanical contact with other solid or liquid objects, in particular, in moving contacts. In such applications, low friction and wear resistance are of interest. Lubrication is the standard way to address friction and wear problems. Depending on application, liquid and/or solid lubricants can be used. Liquid lubricants are the preferred choice when long service life, serviceability, corrosion protection, cleaning and cooling are all important. Solid lubricants are used in special cases where the use of liquid lubricants is not an option, due, for instance, to thermal conditions or surrounding environment. Solid lubricants are especially effective in controlling wear in highly loaded sliding contacts and hence are often used in applications being exposed to wear. There are several methods of applying such solid lubricants. Many such methods are based on the application of a paste or liquid containing dispersed solid lubricants onto the surface to be covered, followed by a heat treatment and/or mechanical treatment to remove the binding materials in the paste or liquid, causing the solid lubricant to bind to the surface of the article to be lubricated. However, without having been chemically bonded to the surface, solid lubricants are poorly retained and readily detaches from the surface. As a result, polymer-bonded solid lubricant coatings are most common in practice, including well-known commercial products from Dow Corning, Klueber, Henkel and many others. In these products, a thermoset, UV-set or oxidation-drying polymer binder is used to retain the solid lubricant on the surface. To apply the coating after the nitriding, the surface has first to be cleaned, then coated in a separate step, and then finally cured.

In the case of nitrided objects, such heating and/or mechanical treatment and/or cleaning may influence the composition and properties of the surface of the nitrided object itself. Heating at a low nitrogen potential may e.g. cause de-nitriding of the objects surface and heat treatment and mechanical interaction may alter texture, hardness, etc. of the nitrided object.

Another common way of manufacturing solid lubricant coatings is by means of physical vapor deposition (PVD), plasma-assisted chemical vapor deposition (PA-CVD) and similar vacuum processes, whereby solid lubricants are embedded into a hard coating—such as diamond-like carbon—matrix. This technology is used, in particular, to manufacture products such as Balinit C (Oerlikon), MoST (Teer Coatings) and others. Prior to the PVD (or PA-CVD) coating, too, the surface has to be thoroughly cleaned, and then coated in a separate step.

Nitrided steel articles can also be CVD coated by certain solid lubricants in a separate processing step. This might produce a tribological effect. For instance, one might produce $MoS_2$ and $WS_2$ coating by a CVD process reacting volatile metal carbonyl complexes, $Mo(CO)_6$ and $W(CO)_6$, with mercaptanes or organic sulfides, such as dimethylsulfides. Unfortunately, coatings so produced often tend to be fluffy and exhibit poor adhesion to the substrate. Possible reasons may be found in contamination or gas adsorption on the nitrided surface before coating or in surface modifications during cleaning procedures.

In all of the abovementioned cases, increased process complexity adds to logistic and manufacturing costs.

SUMMARY

A general object of the present technology is to provide solid lubricant-coated nitrided steel articles with enhanced tribological properties.

The above object is achieved by methods and devices according to the independent claims. Preferred embodiments are defined in dependent claims.

In general words, in a first aspect, a method for manufacturing of steel articles comprises nitriding a steel article at a nitrification temperature in the interval 350-650° C., giving a nitrided steel article. The nitrided steel article is quenched in a reactive quenching oil from the nitrification temperature. The reactive quenching oil comprises at least one of S, P, B, Mo and W. Thereby, the quenching additionally comprises coating of the nitrided steel article by a solid lubricant comprising at least one of S, P, B, Mo and W.

In a second aspect, an apparatus for manufacturing of steel articles comprises a nitriding chamber, a quenching volume and conveyor means. The nitriding chamber is configured for nitriding a steel article at a nitrification temperature in the interval 350-650° C., giving a nitrided steel article. The quenching volume comprises reactive quenching oil comprising at least one of S, P, B, Mo and W. The conveyor means is configured for moving the nitrided steel article having the nitrification temperature relative to the cooler quenching volume comprising reactive quenching oil for allowing a quenching of the nitrided steel article in the reactive quenching oil. The quenching forms a solid lubricant comprising at least one of S, P, B, Mo and W on the nitrided steel article.

In a third aspect, a steel article comprises a main body of steel. The main body of steel has a nitrided layer covered by a surface layer of a solid lubricant comprising at least one of S, P, B, Mo and W. The solid lubricant is chemically bonded directly to a freshly provided surface portion of the nitride layer that has a highest nitrogen content.

In a fourth aspect, a quenching oil for provision of a solid lubricant layer onto steel articles. The quenching oil comprises a base oil and additives comprising at least one of S, P, B, Mo and W.

One advantage with the proposed technology is that it results in solid lubricant coated nitrided steel articles with controlled surface properties and enhanced tribological performance. Furthermore, the solid lubricant coated nitrided steel articles are produced in an economical and non-complex process. Other advantages will be appreciated when reading the detailed description.

BRIEF DESCRIPTION OF THE DRAWINGS

The invention, together with further objects and advantages thereof, may best be understood by making reference to the following description taken together with the accompanying drawings, in which:

FIG. 7B is a schematic illustration of another embodiment of an apparatus for manufacturing of steel articles; and FIG. 8 is a diagram illustrating activation temperatures for extreme-pressure antiwear materials.

DETAILED DESCRIPTION

Figure 1:
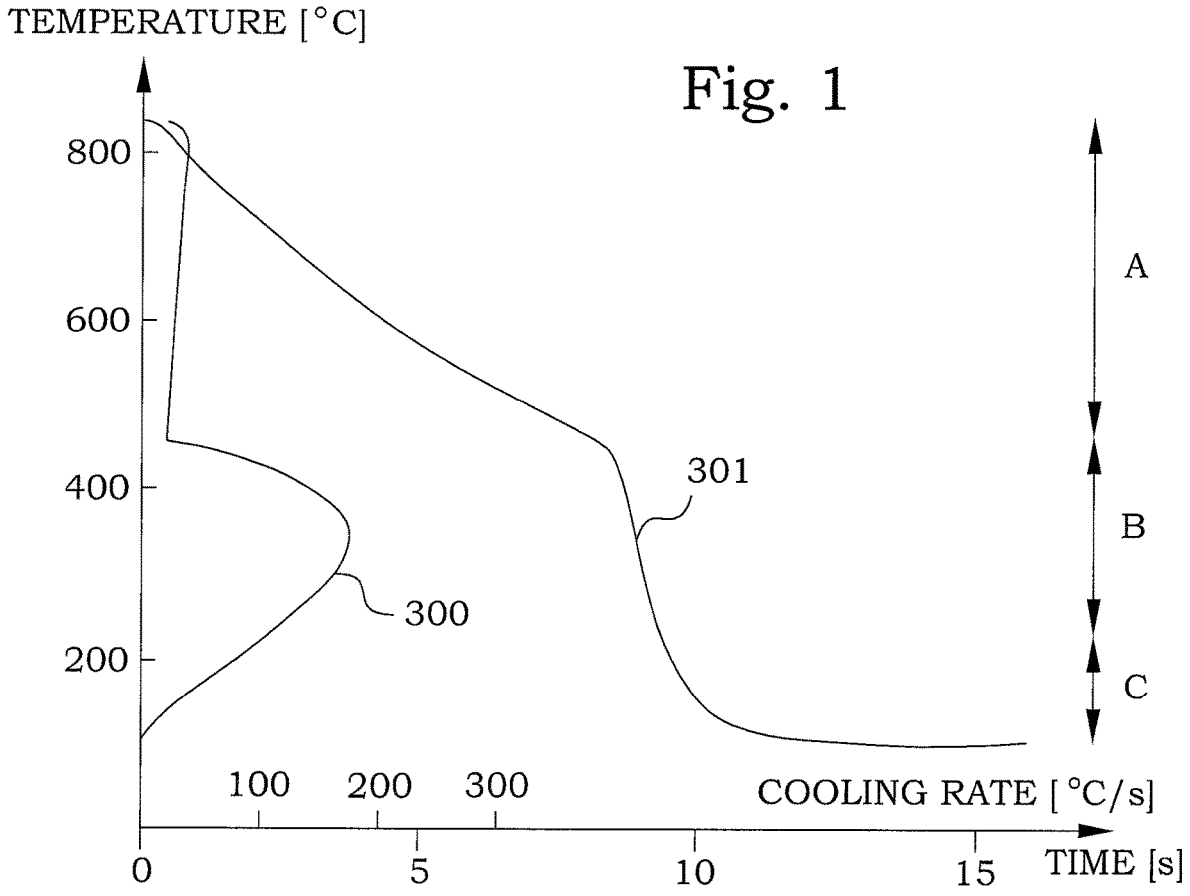
FIG. 1 illustrates a typical quenching curve.

Throughout the drawings, the same reference numbers are used for similar or corresponding elements.

For a better understanding of the proposed technology, it may be useful to begin with a brief overview of different nitriding processes.

Nitriding processes are thermochemical processes that at an elevated temperature provides nitrogen or alternatively both nitrogen and carbon to a steel surface with the purpose to generate a hardened surface layer. The surface layer comprises either a diffusion zone and a compound zone or alternatively only a diffusion zone. The compound zone is a phase transitioned layer comprising nitrides. At higher temperatures, also an austenitic or a martensitic zone may be present. The thermochemical nitriding process can be performed in a gas atmosphere, in a salt bath or by a plasma process. Such processes can be denoted as gas nitriding, gas nitrocarburization, salt bath nitriding, salt bath nitrocarburization, plasma nitriding and plasma nitrocarburization. The nitriding process may be proceeded by a pre-oxidation in the temperature interval of 300-400° C. during 0.5-3 hours.

In gas nitriding, the work piece to be nitrided is placed in a chamber filled with a donor gas at a high temperature. The donor is usually ammonia, which is why it is sometimes known as ammonia nitriding. When ammonia comes into contact with the heated work piece it disassociates into nitrogen and hydrogen. The nitrogen then diffuses onto the surface of the material creating a nitride layer.

In salt bath nitriding, the nitrogen donating medium is a nitrogen-containing salt such as cyanide salt. In this process, nitrogen is diffused into the surface of a metal at sub-critical temperatures at ferritic stage to create a case hardened surface. The salts are also used to donate carbon to the workpiece surface, hence the salt bath process is also known as a nitrocarburizing process. The temperature used in all nitrocarburizing processes is 550-570° C. One advantage of salt nitriding is that a higher diffusion depth can be achieved in the same time period than with any other nitriding method. Other advantages are quick processing time and simple operation.

Plasma nitriding, also known as ion nitriding, plasma ion nitriding or glow-discharge nitriding, is a modern thermochemical treatment which is carried out in a mixture of nitrogen, hydrogen, and an optional carbon spending gas in the case of nitrocarburizing. A glow discharge with a high ionization level is generated around the parts placed in a reaction chamber. As a result, nitrogen-rich nitrides are formed at the surface.

Plasma nitriding allows modification of the surface according to the desired properties. Tailor made layers and hardness profiles can be achieved by adapting the gas mixture: from a compound layer-free surface with low nitrogen contents up to 500 microns thick, to a compound layer with high nitrogen contents and an add-on of carbonic gas (plasma nitrocarburation). The wide applicable temperature range enables a multitude of applications, beyond the possibilities of gas or salt bath processes.

Since nitrogen ions are produced by ionization, differently from gas or salt bath, plasma nitriding efficiency does not primarily depend on the temperature. Plasma nitriding can thus be performed in a broad temperature range, from 260° C. to more than 600° C. For instance, at moderate temperatures, stainless steels can be nitrided without the formation of chromium nitride precipitates and will hence maintain their corrosion resistance properties.

Various steel types can be beneficially treated with plasma nitriding. Particularly when applied to higher alloyed steels, plasma nitriding imparts a high surface hardness which promotes high resistance to wear, scuffing, galling and seizure. Fatigue strength is increased mainly by the development of surface compressive stresses. Plasma nitriding is a smart choice whenever parts are required to have both nitrided and soft areas.

Typical applications include gears, crankshafts, camshafts, cam followers, valve parts, extruder screws, pressure-die-casting tools, forging dies, cold forming tools, injectors and plastic-mould tools, long shafts, axis, clutch and engine parts. Plasma nitriding and plasma nitrocarburising are often preferred to the corresponding gas processes if masking is required.

A diffusion zone is a nitrogen influenced surface layer where incorporated nitrogen influences the hardness of the steel by solution hardening and precipitation hardening.

A compound zone is a phase-transitioned surface layer comprising iron nitrides (Y'-nitride and/or ε-nitride), carbonitrides and nitrides with alloying elements of the steel.

All iron based steel materials can be treated by a nitriding process, comprising but not limited to carbon steels, low-alloyed steels, engineering steels, hardening and temper steels, case hardened steels, tool steel, stainless steel, precipitation hardening steels/Stainless steels and other steel variants.

Quenching oil and heat treatment fluids are designed for rapid or controlled cooling of steel or other metals as part of a hardening, tempering or other heat-treating process, such as nitriding.

Quench oil serves two primary functions. It facilitates hardening of steel by controlling heat transfer during quenching, and it enhances wetting of steel during quenching to minimize the formation of undesirable thermal and transformational gradients which may lead to increased distortion and cracking.

Therefore, in development of quenching oils, several properties are usually taken into consideration. The quenching oil should have ability to deliver constant quenching performance and cooling speed. The quenching oil also preferably presents ability to withstand high thermal shocks. The quenching oil should also provide oxidation resistance, of ingredients of the oil as well as to the quenched work piece. The quenching oil should also be selected to give a good surface cleanliness and no deformation of hardened castings.

It is known that many extreme-pressure antiwear (EP/AW) additives can be reacted with metal surfaces upon heating. In "Special Report: Trends in extreme pressure additives", by N. Canter, Tribology and Lubrication Technology, 2007, page 11, activation temperatures of different classes of EP/AW additives are presented. These findings are illustrated in FIG. 8. It would therefore be an idea to suggest that heating steel parts in an additivated oil bath or molten salt bath could be used for deposition of low-friction solid lubricant film, see e.g. GB 782,263 or WO 03/091478. However, this direct method has an obvious limitation, since the reactivity barrier for many additives lies well above 300° C., and at so high a temperature, uncontrolled hardness loss will occur, which is not acceptable.

However, the technology presented in the present disclosure instead utilizes heat-induced deposition of solid lubricants onto a nitrided surface. The temperatures at which typical nitriding processes are performed are high enough also to initiate solid lubricant formation. However, difficulties to provide suitable components of the solid lubricant into the nitriding chamber itself makes a direct coating troublesome.

Instead, the present technology focusses on the last process in which the high temperatures are involved—the quenching. By using a reactive quenching oil, hardening/quenching can be combined with deposition of a solid lubricant film. The only heat source used to trigger the chemical reaction is the heat retained by steel parts after the nitriding step. During the nitriding, the parts are typically heated up to 350-650° C. This temperature is high enough to initiate a reaction with specific EP/AW additives present in the quenching oil. The reactive quenching oil contains one or more surface-reactive compounds serving as carriers of at least one of the following chemical elements: S, P, B, Mo and W. The overall cooling speed in the reactive quenching process is similar to that for a regular quenching process, topping to 50-250° C./s, and therefore, the overall quench time and hardness of the treated parts will be identical to a non-reactive quenching processes.

However, it has been found that the outcome of the treatment in a reactive quenching oil, in terms of the surface chemistry, is quite different from traditional quenching. In contrast to conventional quenching, the reactive quenching additionally comprises coating, in the course of the quench operation, of the nitrided steel article by a solid lubricant, containing at least one of the following chemical elements: S, P, B, Mo and W in its chemical composition. Steel parts which underwent reactive quenching exhibit the presence of a solid lubricant film, more than 0.1 μm thick, composed of specific chemical elements originally present in the additive package. This will be discussed further in a few examples below.

It has thus been verified that, despite the fast cooling rate in oil quenching, the heat of the work pieces was still sufficient to induce a chemical reaction between different components of the oil. In a preferred embodiment, by having additives comprising S and at least one of Mo and W, solid lubricants similar to $MoS_2$ and $WS_2$, respectively, can be formed on the surface of the work piece. At the same time as the coating by solid lubricant substances, the ordinary processes induced by the quenching, such as e.g. hardening, still occur. The solid lubricant substances formed during the quenching are thus bonded directly to the freshly nitrided and hardened surface. One result of this is that the solid lubricant is chemically bonded directly to a portion of the nitride layer that has a highest nitrogen content. Furthermore, if no oxygen is allowed to reach the nitrided work piece, except where included in the nitriding process, the bond between the solid lubricant and the nitride layer becomes essentially oxygen-free, which typically enhance the bonding strength.

The main function of quench oil in prior art is to enable hardening of steel by rapid chilling. Having relatively high thermal conductivity and good wetting properties, quench oil also help to minimize thermal gradients which may lead to distortion and cracking. FIG. 1 illustrates an example of a typical cooling curve 301. The curve 300 illustrates the cooling rate. When a hot metal piece is immersed into the oil, a vapor layer near the metal surface is momentarily generated due to oil boiling or thermal degradation. The properties of the vapor layer depend on the base oil type and surface-active additives used in the quench oil formulation. As long as such a vapor blanket is there, the cooling rate is relatively slow because the vapor layer acts as a thermal insulator. A typical cooling rate could be around 20-40° C./s. This corresponds to the range indicated by A in FIG. 1. The vapor blanket stage is followed by nucleate boiling stage B. Nucleate boiling begins when the surface temperature drops to the point where the vapor layer becomes unstable and bubble formation occurs due to boiling. This stage exhibits the greatest heat transfer rates of the overall quench cooling process, and may reach 50-250° C./s. It is at this stage that the surface reaction with EP/AW additives present in the reactive quench oil is initiated. Accordingly, light base oils with low boiling temperatures are better suited for use in combination with more reactive additives, such as phosphates, while heavy base oils with high boiling temperature are better suited for use in combination with less reactive additives, such as sulfides. When the temperature of the metal surface drops below the boiling point of the oil, convective cooling (C-stage) takes over. For convective cooling, the cooling intensity depends on oil viscosity, with lower viscosities enabling more rapid cooling. The quench process illustrated in FIG. 1 should be understood as an example of a general quench process. The actual numbers for the cooling rates at the different stages may vary depending on the actual content. Some of this will be discussed more in detail further below. However, the art of modifying cooling rates is, as such, well known in prior art.

The process of using heat stored by the workpiece after heat treatment as an energy source for obtaining a solid lubricant layer in conjunction with quenching would, as such, also be possible to perform on other types of heat treated articles that are normally cooled by quenching or that can be cooled by quenching, e.g. during case hardening of steels.

Figure 2:
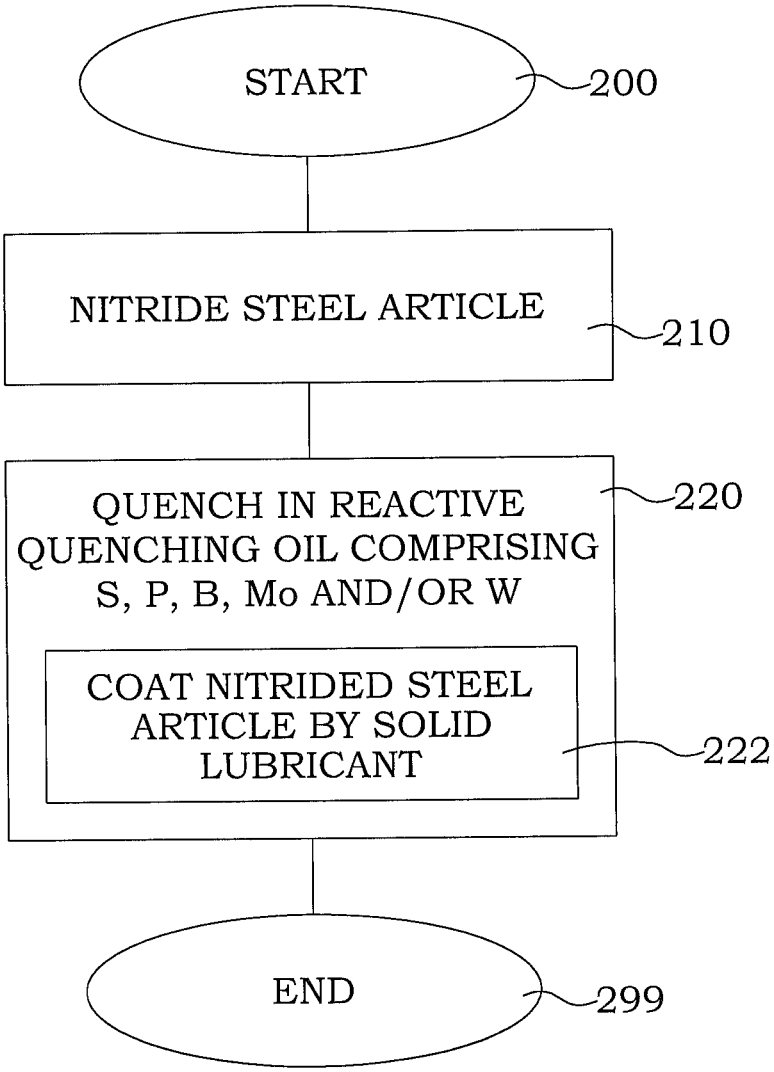
FIG. 2 is a flow diagram of steps of an embodiment of a method for manufacturing of steel articles.

FIG. 2 illustrates a flow diagram of steps of an embodiment of a method for manufacturing of steel article. The process starts in step 200. In step 210, a steel article is nitrided at a nitrification temperature in the interval 350-650° C. This nitriding results in a nitrided steel article. In step 220, the nitrided steel article is quenched in a reactive quenching oil from the nitrification temperature. The reactive quenching oil comprises at least one of S, P, B, Mo and W. Thereby, the step of quenching 220 additionally comprises the step 222 of coating of the nitrided steel article by a solid lubricant comprising at least one of S, P, B, Mo and W. The process ends in step 299. In a preferred embodiment, the reactive quenching oil comprises S and at least one of Mo and W.

Higher quenching speeds are typically not changing the result of the nitriding treatment. However, the higher quenching speed, the shorter the time interval during which the additives present in the quenching oil can react with the steel article. It is therefore in general not very useful to have too fast quenching when considering the coating by the solid lubricant. It is currently considered to be advantageous if the step of quenching is performed with a maximum cooling speed of less than 250° C./s. However, with increasing concentrations of reactive components in the quenching oil, higher quenching speeds become feasible for producing the solid lubricant coating.

For typical operation conditions, it has been found that, in order to produce a compact solid lubricant coating, the reactive quenching oil preferably comprises at least 0.1% of weight of the doping elements, such as e.g. S, P, B, Mo and/or W. Increasing the additive treat levels speeds up deposition of solid lubricant yet increases the cost for shorter quench oil service life and thus increases operational costs. This sets a preferred upper limit for the content of the doping elements in the quenching oil at around 10% of weight.

In a preferred embodiment, the quenching step is performed directly in connection with the end of the nitriding step. In such cases, no diffusion or other time-dependent effects may influence the result of the nitriding and since the nitriding atmosphere prohibits unwanted substances to reach the surface of the steel article, a "clean" surface on which the solid lubricant coating is to be performed can be ensured.

If an immediate quenching cannot be performed, it is preferred that the nitrided steel article is maintained in a clean atmosphere with a high nitrogen potential an entire time between the step of nitriding and the step of quenching, and even more preferably if the atmosphere presents a nitrogen potential that is high enough to prevent de-nitriding of the surface of the nitrided steel article.

If an immediate quenching cannot be performed, it is also preferred that the nitrided steel article is maintained at the nitrification temperature an entire time between the step of nitriding and the step of quenching.

It is, however, possible to perform the nitriding and reactive quenching steps separated in time. However, the nitriding then typically has to be ended by a non-reactive quenching, and a subsequent heating of the nitrided steel article back to the high temperatures is necessary before the reactive quenching can take place. This solution is, however, not very advantageous, since it involves double heating processes and uncertainty of the role of the second quenching to the properties of the nitrided steel article.

In a particular embodiment of the method for manufacturing of steel article, the nitriding step is performed according to the Corr-I-Dur® process. Corr-I-Dur® is a thermochemical treatment, proprietary for Bodycote, for simultaneous improvement of corrosion resistance and wear properties through generating an iron nitride-oxide compound layer. Corr-I-Dur® treatment involves a combination of various low temperature thermochemical process steps, mainly gaseous nitrocarburizing and oxidizing. In the process, a boundary layer consisting of three zones is produced. The diffusion layer forms the transition to the substrate and consists of interstitially dissolved nitrogen and nitride precipitations which increase the hardness and the fatigue strength of the component. Towards the surface it is followed by the compound layer, a carbonitride mainly of the hexagonal epsilon phase. The $Fe_3O_4$ iron oxide (magnetite) in the outer zone takes the effect of a passive layer comparable to the chromium-oxides on corrosion resistant steels. Due to the less metallic character of oxide and compound layer and the high hardness abrasion, adhesion and seizing wear can be distinctly reduced. Corr-I-Dur® has very little effect on distortion and dimensional changes of components compared to higher temperature case hardening processes.

Typical applications of Corr-I-Dur® include brake pistons, ball joints, pump covers, wiper axis, differential axis, selector shafts, bolts, bushings and fastener elements for automotive applications. Also, hydraulic pistons and housings, several axis and shafts for general industry use. Especially, fill chambers and casting dies in aluminium die casting processes get benefit by the low reactivity between molten metal and the Corr-I-Dur® surface. Corr-I-Dur® can be applied to nearly all plain and low alloyed ferrous materials as case hardening, heat treatable, cold forming and easy machining steel.

Figure 3:
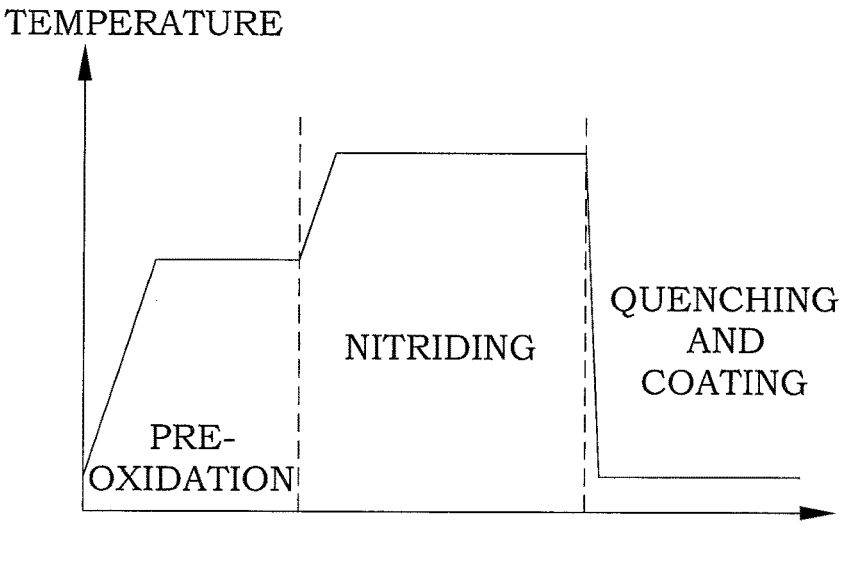
FIG. 3 illustrates a typical temperature/time diagram of a nitriding process.

In this particular embodiment, heat treatment furnaces equipped to provide a protecting and controlled atmosphere during both heating and cooling have been used. A steel of the type SS2172 was used in this particular embodiment. The process started with a preheating and pre-oxidation at 400° C. for about 1-2 hours in air. This pre-oxidation is performed to ensure an even nitrocarburizing result for this steel. This is schematically illustrated in FIG. 3. During the main nitrocarburizing a gas mixture of 35% ammonia ($NH_3$), 5% carbon dioxide ($CO_2$) and 60% nitrogen gas ($N_2$) was used, measure in % by volume. The nitrocarburizing was performed at 580° C. The total gas flow corresponded to 3.5 times the volume of the furnace per hour. This total gas flow influences the nitrogen activity, but is dependent on furnace and has typically to be adapted for each furnace type. The nitrogen activity, $a_N$, during the nitrocarburizing step varied between 2.5 and 5, however, according to earlier experience, nitrogen activities in the range of 0.2 to 20 are possible to use for creating requested results. In the present embodiment, a nitrided layer with a compound layer is the goal, which requires a concentration of nitrogen in the surface of at least 6% by weight.

The type of compound zone that was achieved and studied for this particular embodiment has a composition of pure ε nitride or a mixture between ε nitride and γ' nitride. These particular experiments gave a nitrocarburizing layer with a compound zone thickness of 10-25 μm.

The quenching is performed in a cooling chamber directly connected to the nitrocarburizing furnace. The atmosphere in the cooling chamber has during the experiments had the same composition as the atmosphere in the nitrocarburizing furnace. The nitrogen activity was similar, which reduces the risk for de-nitrification during the transport and quenching. This atmosphere has had a main composition of nitrogen gas ($N_2$), hydrogen gas, ($H_2$), ammonia ($NH_3$), carbon monoxide (CO), carbon dioxide ($CO_2$) and in some cases small amounts of water ($H_2O$).

Many alternative embodiments are also possible. First of all, the basic material can be varied. Experiments have been performed on steels of SS2541, SS2244, SS2142, SS2242 and SS1265, all of which have given a fully satisfactory result. As mentioned before, essentially all iron based steel materials can be treated by a nitriding process, comprising but not limited to carbon steels, low-alloyed steels, engineering steels, hardening and temper steels, case hardened steels, tool steel, stainless steel, precipitation hardening steels/Stainless steels and other steel variants.

The heating and pre-oxidation can also be performed in alternative ways. Pre-oxidation temperatures in the interval of 300° C. to 450° C. are common in the technical field of nitriding, and are basically selected in dependence of the steel quality that is to be treated. For some materials, pre-oxidation is, however, not to recommend. However, the existence of a pre-oxidation step has no direct influence on the final quenching-coating operation.

Other gas mixtures during the nitriding process can be utilized. As one non-limiting example, a nitrocarburizing atmosphere of only ammonia and carbon dioxide is possible to use. For end products, where the carburizing is of less importance, pure nitriding can also be performed. An atmosphere of only ammonia can then be utilized, possibly with nitrogen gas mixed in. For creating a nitrogen and carbon atmosphere, an endogas mixed with ammonia can be used.

Also the process temperatures during the nitriding can be different. Nitrocarburization temperatures from 500° C. to 620° C. are used in standard nitrocarburization processes and gives a possibility to adapt the nitriding process to the selected basic material, i.e. the steel quality. For instance, nitrided layer thicknesses from a fraction of a micrometer up to 35 μm have been achieved, and this increase the possibility to tailor the properties of the final material.

The adaptation of gas mixtures, temperatures and processing times gives a possibility to control the nitriding for achieving particular types of nitrided surfaces. The quenching step to follow can be performed on any nitrided or nitrocarburized surface. In particular, such surfaces may be entirely without compound zone, or with a pure y' nitride if this is to prefer for the intended final application or substrate material type.

After the nitriding step, the nitrided steel article was immediately quenched in a reactive quenching oil.

Non-exclusive examples of tungsten carriers suitable for use in reactive quenching oil formulations include simple tungstates, thiotungstates, tungsten dithiocarbamates, tungsten dithiophosphates, tungsten carboxylates and dithiocarboxylates, tungsten xanthates and thioxanthates, polynuclear tungsten complexes containing carbonyl, cyclopentadienyl and sulfur as ligands, halogen containing complexes of tungsten with pyridine, bipyridine, nitriles and phosphines as ligands, adducts of tunstic acid with fatty glycerides, amides and amines. Known examples of commercial products suitable for this purpose include Vanlube W-324 from Vanderbilt International and Na-lube FM-1191 from King Industries.

Non-exclusive examples of molybdenum compounds suitable for use in reactive quenching oil formulations are simple molybdates, thiomolybdates, molybdenum dithiocarbamates, molybdenum dithiophosphates, molybdenum carboxylates and dithiocarboxylates, molybdenum xanthates and thioxanthates, polynuclear molybdenum complexes containing carbonyl, cyclopentadienyl and sulfur as ligands, halogen containing complexes of molybdenum with pyridine, bipyridine, nitriles and phosphines, adducts of molybdic acid with fatty glycerides, amides and amines. Known examples of commercial products suitable for this purpose include Molyvan L and Molyvan 855 from Vanderbilt International, and Na-lube FM-1187 from King Industries.

Non-exclusive examples of boron compounds suitable for use in reactive quenching oil formulations are dispersed boric acid, dispersed metal borates, adducts of boric acid with amines and aminoalcohols, borate esters and ionic liquids containing boron cluster anions. Known examples of commercial products suitable for this purpose include Vanlube 289 from Vanderbilt International, and Na-lube FM-1187 from King Industries.

Non-exclusive examples of sulfur compounds suitable for use in reactive quenching oil formulations are elementary sulfur or a variety of oil soluble organic sulfur compounds, the so-called sulfur carriers, including but not limited to sulfurized hydrocarbons, sulfurized fatty acids and sulfurized esters.

Non-exclusive examples of phosphorus compounds suitable for use in reactive quenching oil formulations are phosphoric acid triesters, such as tricresylphosphate, amine-neutralized mixtures of mono- and dialkyl phosphoric acid partial esters, ethoxylated mono- and dialkylphosphoric acids, dialkyl dithiophosphates, etc.

Different compositions of the quenching oil were tested. In a preferred group of embodiment, a naphthenic base oil T22 from Nynas Petroleum was used in combination with a universal quench oil additive package, OLOA 4751, from Oronite, used at treat levels between 1 to 10% of weight, and molybdenum phosphothioate, used at treat levels between 1 and 20% of weight in different tests.

In some other test embodiments, other common additives to quenching oils were used. Fatty triglyceride, Plasmoil MR-A from Micros Lubrication Technologies, was added in concentrations of up to 10% of weight to boost dispersancy and to improve wetting. Dialkyl polysulfide, Additin RC 2540, was added in amount up to 10% of weight to provide an additional source of S. Zinc dithiophosphate, OLOA 262, from Oronite was used in concentrations up to 5% of weight to reduce the oxidation of the quenching oil and to provide an additional source of S and P. The main purpose of these extra additives is to prolong the life time of the quenching oil, with no decisive effect on the formation of the solid lubricant layer.

Figure 4:
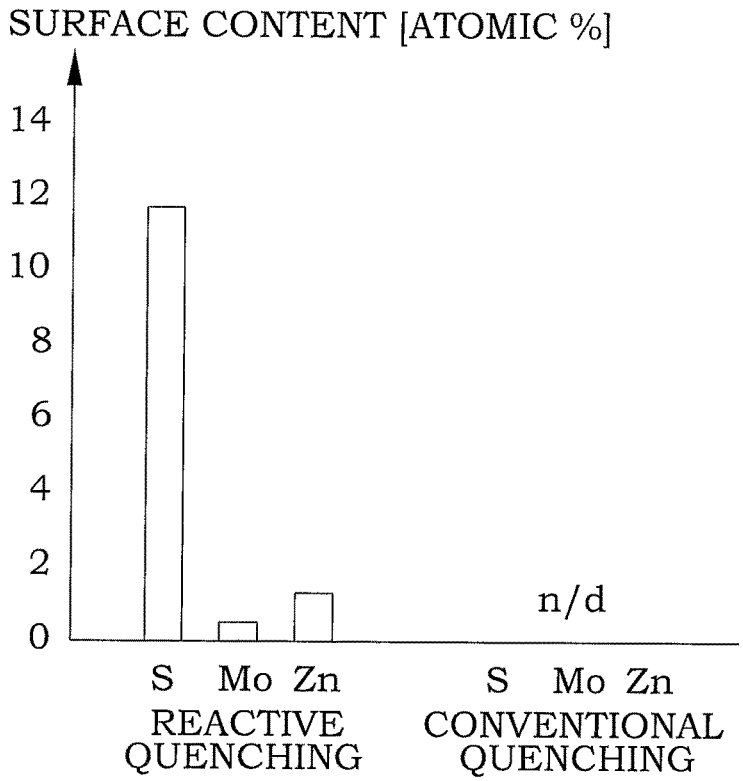
FIG. 4 is a diagram comparing surface content of a steel product conventionally quenched with a steel product being reactively quenched.

FIG. 4 is a diagram illustrating the surface compositions for one sample quenched in a reactive oil and a similar sample quenched in a conventional oil. The surface composition was analyzed using X-ray fluorescence measurements. It is easily noticed that the chemical surface composition of specimen processed using the reactive quenching method is very different from that for specimen processed using the conventional method. The concentration of doping elements such as S, Zn and Mo are below the detection limit in the case of the conventional quenching.

Figure 5:
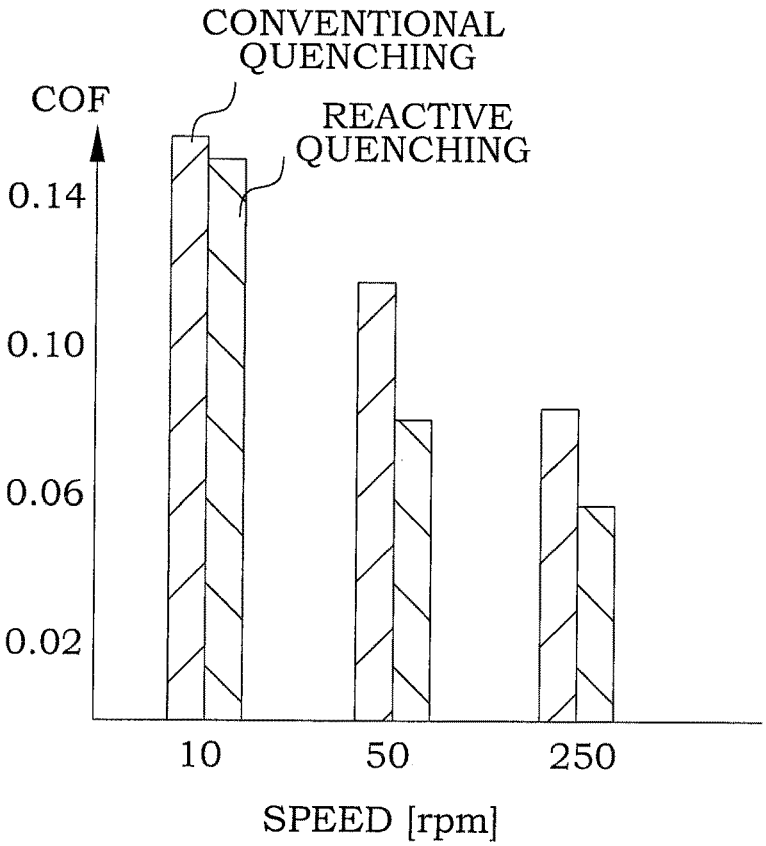
FIG. 5 is a diagram illustrating friction properties of a steel product conventionally quenched and of a steel product being reactively quenched.

Also, the appearance and the tribological properties of the treated parts become quite different. FIG. 5 is a diagram illustrating coefficients of friction (COF) for different rotational speed for surfaces quenched in a reactive quenching oil according to the above presented compositions, compared with surfaces quenched in a conventional manner. It can easily be concluded that reactive quenching produces surfaces with a lower coefficient of friction as compared to the conventional quenching method. The presented data are obtained in a lubricated friction test contact with a cross-cylinder configuration test specimen—probe arrangement at different specimen rotation speeds. The initial Hertzian contact pressure was around 1 GPa.

Figure 6:
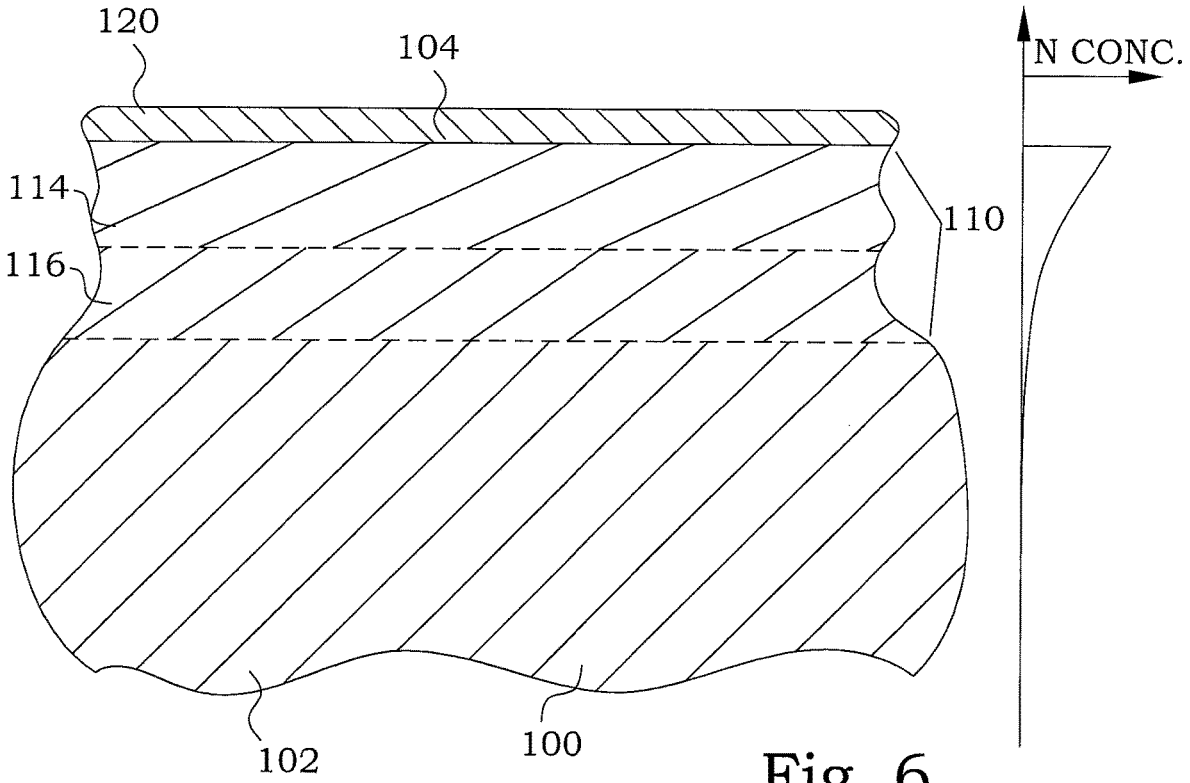
FIG. 6 is a schematic illustration of a part of a surface region of a steel product being reactively quenched.

The steel articles produced by reactive quenching using at least one of S, P, B, Mo and W thus present a surface layer of a solid lubricant comprising at least one of S, P, B, Mo and W. FIG. 6 illustrates schematically a cross-section of a portion of such a nitrided steel article 100. The bulk metal alloy is a steel 102 corresponding to the original steel article before the nitriding step. During the nitriding, the heat treatment may change the metal phases of the original steel article, but with a same composition. In some applications, it is advantageous to have a martensitic and/or austenitic structure, giving the article a high hardness. Close to the surface 104 of the steel article 100, a nitrided layer 110 or boundary layer has been formed, in this embodiment consisting of two zones 114 and 116. A diffusion layer 116 or nitrogen diffusion zone forms the transition to the bulk material 102. A compound layer 114 or nitrogen compound zone comprises typically a nitride/carbonitride mainly of the hexagonal epsilon phase. The average nitrogen concentration increases towards the surface for a freshly nitrided product. The boundaries between the zones are typically not sharp, but are instead a gradual transition from one layer constitution to another. The nitrogen concentration increases typically from the bulk 102 of the steel article 100 towards the surface, as schematically indicated by the diagram at the right side of FIG. 5. The surface layer of a solid lubricant 120 bonds directly to the nitrided layer 110, and in this particular embodiment to the compound layer 114. In other words, the solid lubricant is chemically bonded directly to a freshly provided surface portion of the nitride layer having a highest nitrogen content.

In another embodiment, e.g. where a Corr-I-Dur® process constitutes the basic nitriding process, the nitrided layer additionally comprises an outer zone, which typically comprises iron oxide and takes the effect of a passive layer. Preferably, solid lubricants based on P and/or B may advantageously be used on such surfaces.

By maintaining the steel article in a clean atmosphere without major contaminants, e.g. with a high ammonia or nitrogen content, during the transfer to the quenching, de-nitriding of the surface and contamination of the surface will be reduced. This means that the surface on which the solid lubricant is to be formed is clean and has a high nitrogen concentration. The bond between the formed solid lubricant and the nitride layer thereby becomes essentially contaminant-free.

In other embodiments, the nitriding step can be performed according to other nitriding processes, known as such in prior art. The details of these alternative nitriding processes do not influence the solid lubricant coating in any decisive manner, and are thus not described in more detail here. The nitrided layer may in such embodiments comprise e.g. only a nitrogen diffusion zone or only a nitrogen diffusion zone and a nitrogen compound zone.

The quenching speed and the concentrations of doping elements (S, P, B, Mo, W) in the quenching oil put some restrictions to the thicknesses of the solid lubricant that can be achieved. In order to achieve desired tribological properties, it is preferable to have a uniform surface coverage by a coherent solid lubricant layer. Due to existence of typical surface roughness and an essentially stochastic formation of the solid lubricant layer, it is preferable to have a layer of the solid lubricant that has an average thickness of more than 0.1 μm. This has readily been achieved by the tests presented further above.

A too thick solid lubricant layer may in certain applications be disadvantageous. A part from faster depletion of quenching oil of essential additives, a thick layer is more likely to flake off, contaminating the quenching bath, and for very thick layers, the allowed dimensions of the steel article may be changed beyond tolerance limits. Moreover, by the present technique of reactive quenching, the concentrations in the oil of the substances to react and/ or the time the steel article has a temperature high enough to cause a formation of the solid lubricant layer typically set some limitations on the maximum layer thickness. It is presently believed that it is preferred to have the layer of the solid lubricant with a thickness not exceeding a few μm.

The present technology is applicable to many kinds of articles. Some non-limiting examples are gears, crankshafts, camshafts, racks, pinions, axles, races, drive shafts, center pins and cylinder blocks for hydraulic motors, vanes for pumps, piston skirts, chain components, slideways, cam followers, valve parts, extruder screws, die-casting tools, forging dies, extrusion dies, firearm components, injectors, plastic-mold tools, conveyor guides, etc.

Figure 7A:
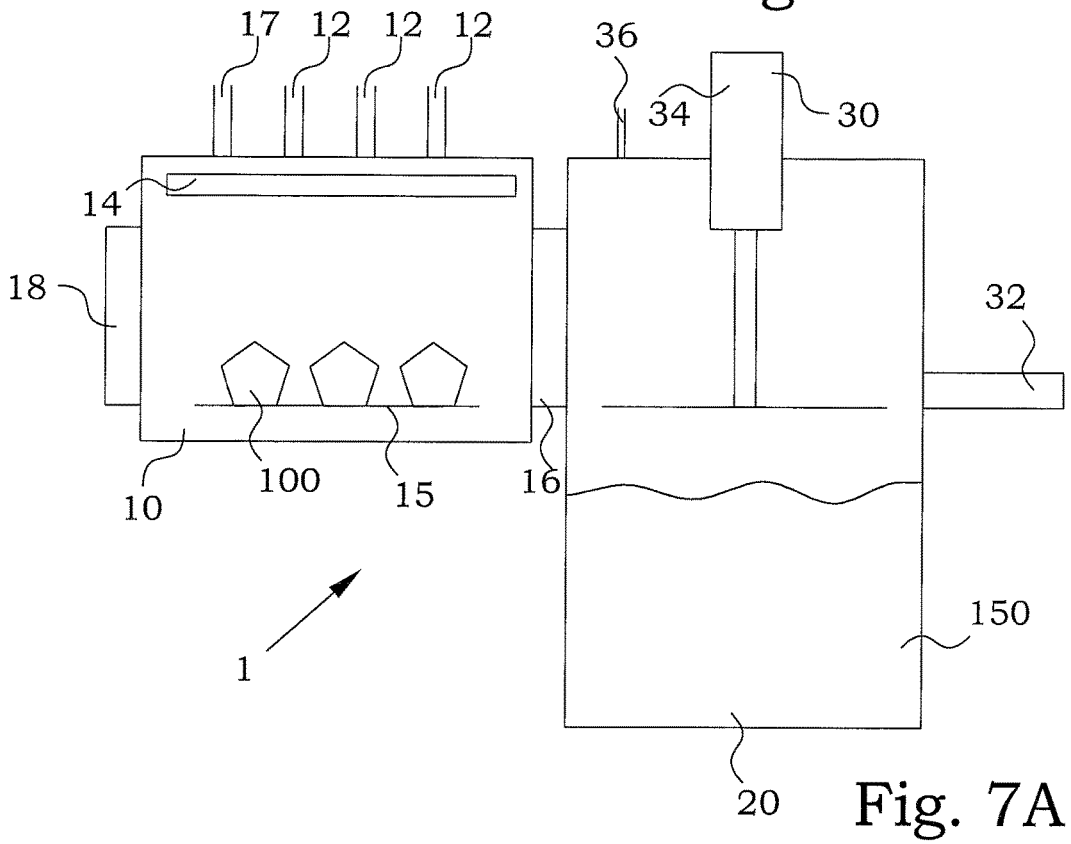
FIG. 7A is a schematic illustration of an embodiment of an apparatus for manufacturing of steel articles.

FIG. 7A illustrates schematically an embodiment of an apparatus 1 for manufacturing of steel articles 100. The apparatus 1 comprises a nitriding chamber 10. The nitriding chamber 10 is configured for nitriding a steel article 100 at a nitrification temperature in the interval 350-650° C., giving a nitrided steel article. In this embodiment, the nitriding chamber 10 comprises an inlet valve 18, through which the steel articles 100 are entered and positioned on a holder 15. Heater elements 14 are provided in the nitriding chamber 10 for providing the required temperatures. A number of gas inlets 12 are provided, and the provision of gas is controlled in dependence of the required gas atmosphere inside the nitriding chamber 10. The atmosphere inside the nitriding chamber 10 is successively changed and gas is therefore allowed to exit the nitriding chamber through a gas outlet 17. The gas inlets 12, the gas outlet 17 and the heater elements 14 are preferably controlled based on sensors (not shown) surveilling the temperature and atmosphere composition inside the nitriding chamber 10.

When the nitriding process is ended, an outlet valve 16 to a quenching volume 20 is opened. The quenching volume 20 comprises reactive quenching oil 150 comprising at least one of S, P, B, Mo and W. Gas inlets 36 to the quenching volume 20 ensures that an atmosphere in the quenching volume 20 has a nitrogen activity sufficient to mitigate de-nitrification of the steel articles 100. Typically, nitrogen gas is added.

Conveyor means 30 are provided for moving the nitrided steel articles 100 relative to said quenching volume comprising reactive quenching oil. In this embodiment a horizontal translation means 32 is arranged for entering through the outlet valve 16, mechanically connecting to the holder 15 and retracting back to the quenching volume 20. The outlet valve 16 may thereafter close in order to protect the nitriding chamber 10 for gases and liquids emitted from the reactive quenching oil 150 during quenching. A vertical translation means 34 of the conveyor means 30 continues the moving of the steel articles 100 and by a vertical translation, the steel articles 100 are quenched in the reactive quenching oil 150. The conveyor means 30 thereby moves the steel articles 100 when still having the nitrification temperature, and allows the nitrided steel articles 100 to be quenched in the reactive quenching oil 150 of the quenching volume 20. This quenching results in that a solid lubricant comprising at least one of S, P, B, Mo and W is formed on the nitrided steel article.

In this particular embodiment, the conveyor means 30 is thus arranged for moving the nitrided steel article 100 in an atmosphere of a nitrogen potential prohibiting de-nitriding an entire distance between the nitriding chamber 10 and the quenching volume 20.

Also, in this embodiment, if the transport is performed without delay, the conveyor means 30 is arranged for moving the nitrided steel article 100 at the nitrification temperature an entire distance between the nitriding chamber 10 and said quenching volume 20.

In an alternative embodiment, the nitriding chamber 10 may have only one valve, both for introducing and removing the steel articles 100 from the nitriding chamber 10.

FIG. 7B illustrates schematically another embodiment of an apparatus 1 for manufacturing of steel articles 100. In this embodiment, the quenching volume 20 is situated beneath the nitriding chamber 10. The conveyor means 30 are here adapted for moving the steel articles 100 vertically into the quenching oil 150.

One key component in the presented technology is the reactive quenching oil. In a preferred embodiment, a quenching oil for provision of a solid lubricant layer onto steel articles comprises a base oil and additives comprising at least one of S, P, B, Mo and W. In a preferred embodiment, the quenching oil comprises S and at least one of Mo and W.

This basic aspect can be varied in many respects. Some embodiments have already been presented in connection with the detailed embodiment of the method presented above.

Depending on the quench type—cold, warm or hot—different mineral-based oils are preferably used in formulations: from 100N for cold quench to 600N for hot quench. Accordingly, lower viscosities oils, such as T22 (Nynas), SN100 or SN200 (Total), are more suitable for cold quench with accelerated or medium cooling, while heavier products, such as SN500 (Total) or T100 (Nynas) are more suitable for hot quench with accelerated cooling.

The most important properties of quench oil are viscosity (ASTM D 445), flash point (ASTM D 92 or D93), water content (ASTM D 6304), acid number (ASTM D 664), precipitation number (ASTM D 91), metal content (ASTM D 4951 or D6595) and GM quenchometer (ASTM D 3520) or cooling curve analysis (ASTM D 6200). Cooling curve analysis allows easy detection of changes in the cooling rate due to oil oxidation or water contamination. Within certain limits, cooling curve can be "corrected" by using additives.

The additivation strategy is typically invariable with respect to temperature and aims for providing an oil that is more stable during the quenching process. The most common additives being phenolic and aminic antioxidants, total base number buffering and detergency additives including calcium sulphonates, phenates, and ashless aminic, hydrocarbyl substituted succinic esters, amides and imides. Such additivation is, as such, known in prior art, e.g. from the U.S. Pat. No. 6,239,082 or U.S. Pat. No. 7,358,217. Non-exclusive examples of known commercial packages are OLOA 4750, OLOA 4751 from Oronite and LZ 5357 from Lubrizol. Preferably, the quenching oil comprises these quench oil additives in an amount of at most 10% of weight.

A further particular embodiment of a quench oil that advantageously has been used for reactive quenching can be composed according to:

| | |
|---|---|
| Universal quench oil additive package, Lubrizol 5357S | 4 to 6% |
| Tungsten thiocarbamate | 1 to 10% |
| Base oil, NS 100 | the rest |

Yet a further particular embodiment of a quench oil that advantageously has been used for reactive quenching can be composed according to:

| | |
|---|---|
| Universal quench oil additive package, Lubrizol 5941S | 2 to 6% |
| Antioxidant Irganox L150 | 0.1 to 0.5% |
| Antioxidant DBDS | 0.1 to 0.5% |
| Borate ester Vanlube 289 | 1 to 10% |
| Base oil, T 110 | the rest |

The embodiments described above are to be understood as a few illustrative examples of the present invention. It will be understood by those skilled in the art that various modifications, combinations and changes may be made to the embodiments without departing from the scope of the present invention. In particular, different part solutions in the different embodiments can be combined in other configurations, where technically possible. The scope of the present invention is, however, defined by the appended claims.

The invention claimed is:

1. A method for manufacturing of steel articles, comprising the steps of:

nitriding a steel article at a nitrification temperature in the interval 350-650° C., giving a nitrided steel article; and quenching said nitrided steel article in a reactive quenching oil from said nitrification temperature;

said reactive quenching oil comprising at least one of S, P, B, Mo and W;

whereby said step of quenching additionally comprises coating of said nitrided steel article by a solid lubricant comprising at least one of S, P, B, Mo and W.

2. The method according to claim 1, wherein said reactive quenching oil comprises at least 0.1% of weight of the total of S, P, B, Mo and W.

3. The method according to claim 1, wherein said reactive quenching oil comprises at most 10% of weight of the total of S, P, B, Mo and W.

4. The method according to claim 1, comprising the further step of maintaining said nitrided steel article in an atmosphere of a nitrogen potential prohibiting de-nitriding an entire time between said step of nitriding and said step of quenching.

5. The method according to claim 1, comprising the further step of maintaining said nitrided steel article at said nitrification temperature an entire time between said step of nitriding and said step of quenching.

6. The method according to claim 1, wherein said step of quenching is performed with a maximum cooling speed of less than 250° C/s.

* * * * *